United States Patent [19]

Garvin et al.

[11] 4,153,571

[45] May 8, 1979

[54] HEAT DEPENDENT ALKALI GEL CLEANING COMPOSITIONS AND PROCESS FOR CLEANING GREASY SURFACES

[75] Inventors: Donald F. Garvin, Wyandotte; Otto T. Aepli, Southgate, both of Mich.

[73] Assignee: BASF Wyandotte Corporation, Wyandotte, Mich.

[21] Appl. No.: 429,979

[22] Filed: Jan. 2, 1974

[51] Int. Cl.[2] ..... C11D 7/26

[52] U.S. Cl. ..... 252/156; 252/316; 252/DIG. 1; 252/DIG. 2; 252/DIG. 15

[58] Field of Search ..... 252/156, 316, DIG. 1, 252/DIG. 2, DIG. 15

[56] References Cited

U.S. PATENT DOCUMENTS

| | | | |
|---|---|---|---|
| 3,156,655 | 11/1964 | Bright | 252/DIG. 15 |
| 3,335,092 | 8/1967 | Perry | 252/156 |
| 3,740,421 | 6/1973 | Schmolka | 252/316 |

*Primary Examiner*—George F. Lesmes
*Assistant Examiner*—R. Eugene Varndell, Jr.
*Attorney, Agent, or Firm*—Andrew E. Pierce; Bernhard R. Swick; Robert E. Dunn

[57] ABSTRACT

Alkaline cleaning compositions are prepared by combining water, alkali metal hydroxide and certain surfactants which composition forms a gel when applied to a hot surface and a process for the easy removal of greasy soil from such surfaces.

4 Claims, No Drawings

HEAT DEPENDENT ALKALI GEL CLEANING COMPOSITIONS AND PROCESS FOR CLEANING GREASY SURFACES

BACKGROUND OF THE INVENTION

1. Field of the Invention

The present invention relates to aqueous gel compositions which are especially suitable for the removal of greasy soil from surfaces and to a process for the easy removal of such soil. These gel compositions comprise a mixture of water, alkali metal hydroxide and a surfactant which may be either a polyoxyethylene polyoxypropylene copolymer or an ethoxylated alcohol.

2. Prior Art

Various formulations are proposed in the prior art for use in removing greasy soil. Generally they incorporate the use of either an alkaline metal hydroxide or some oxidizing agent in the presence of a surfactant. It has invariably been found necessary in the prior art to incorporate a thickening agent for use with these cleaners. These cleaners have been applied as liquids, painted on as a paste or sprayed on as a foam. Each of these methods has its disadvantages. Liquids tend to run off vertical surfaces before the grease is thoroughly emulsified. The paste type cleaners are difficult to apply and to remove. The foam cleaners require specialized equipment for application.

Our present society of fast service food restaurants incorporates mobile chain frying belts and the like to expedite the preparation of the meals. It is often difficult to clean these surfaces which may be in a vertical position. For convenience, it would be extremely desirable to be able to apply a liquid to the various greasy surfaces and have that liquid form a gel and remain attached to that surface, while the active ingredients are working to emulsify the grease. These same advantages are useful for cleaning ovens and any other surfaces which are exposed to fats which subsequently become glazed due to the high temperatures employed.

SUMMARY OF THE INVENTION

It has now been discovered that it is possible to use liquid alkaline cleaning compositions, which can be sprayed onto surfaces from a variety of generally available devices, and which instantly form a viscous gel when the liquids contact a warm to hot surface. This gel is retained on the surface permitting emulsification of the grease and facilitating the subsequent removal of the greasy residues. The heat of the metal surface aids in the cleaning process. When the cleaning process is complete, the metal surface is allowed to cool below 100° F., the gel reverts to a liquid, and the entire surface may then be wiped clean with a cloth. If desired, the gel may be easily washed off with water instead. It is surprising that this gel phenomonen occurs, as it is well known that most alkaline surfactant solutions tend to show a reduction in viscosity when heated. This same tendency to exhibit a decrease in viscosity is observed with liquids which contain the usual various thickening agents such as gum, starches, cellulose and vinyl polymers. It has also been discovered that preselected gelling temperatures of the cleaning compositions can be obtained by adjusting the ratio of alkaline electrolytes and type and amount of surfactant.

DESCRIPTION OF THE PREFERRED EMBODIMENTS

As used herein, the term gel is defined as a solid or semi-solid colloid containing considerable quantities of water. The particles in the gel are linked in a coherent meshwork which immobilizes the water. The gels of the present invention comprise, based on the total of 100 parts by weight, from about 1 to 7 percent of an alkali metal hydroxide of either sodium or potassium hydroxide, from about 4 to about 30 weight percent of a surfactant, and the balance is water. The surfactants are selected from a group consisting of either an ethoxylated alcohol of the formula $$Y—O(C_2H_4O)_nH$$

wherein Y is a straight chain alkyl group having an average of 19 carbon atoms and n in an integer such that the hydrophile represented by $(C_2H_4O)$ constitutes from about 75 to 95 weight percent of the total weight of the surfactant whose molecular weight is about 1500 and a polyoxyethylene polyoxypropylene copolymer of the formula $$HO(C_2H_4O)_b(C_3H_6O)_a(C_2H_4O)_bH$$

wherein a is an integer such that the hydrophobe base represented by $(C_3H_6O)$ has an average molecular weight of at least 3200 and b is an integer such that the hydrophile represented by $(C_2H_4O)$ constitutes from about 70 to 95 weight percent of the copolymer.

Generally it is desirable that the aqueous composition should not form a gel or thicken below 100° F. in order that these compositions may be used in the liquid form in warm areas. The formulas should also remain fluid when compressed in a pump or spray device but should gel when in contact with metal surfaces at a temperature greater than 100° F. While in general any temperature above 100° F. should be satisfactory, in most applications, the temperatures would not normally exceed 300° F.

EXAMPLE 1

Typical formulations of this invention were evaluated for soil removal. A greasy soil was prepared from a mixture of 9 parts of beef tallow and 1 part of corn starch. This mixture was coated onto metal strips. The metal strips were then heated for 60 minutes at 300° F. in a hot air oven. The metal strips were then coated with formulations A, B, & C which are tabulated below. These products all gelled at temperatures between 115°–128° F. The gels were allowed to remain on the metal strips for 15 minutes. After this time the metal strips were allowed to cool to room temperature, whereupon the gels reliquified and flowed off the metal strips removing the greasy soil. Excellent soil removal was observed.

Formulation A

| | Concentration, % |
|---|---|
| Surfactant B | 12.0 |
| KOH | 3.0 |
| NaOH | 2.0 |
| Water | 82.6 |
| Sodium Metasilicate | 0.2 |
| Phosphoric acid | 0.2 |
| | 100.0 |

-continued

| Formulation B | Concentration, % |
|---|---|
| Surfactant A | 12.0 |
| KOH | 7.0 |
| Water | 81.0 |
| | 100.0 |

| Formulation C | Concentration, % |
|---|---|
| Surfactant A | 15.0 |
| NaOH | 2.0 |
| KOH | 3.0 |
| Water | 80.0 |
| | 100.0 |

Surfactant A is an ethoxylated alcohol of the formula:

$$Y—O(C_2H_4O)_nH$$

wherein Y is a straight chain alkyl group having an average of 19 carbon atoms, n is an integer such that the hydrophile represented by $(C_2H_4O)$ constitutes from about 75 to 95 weight of the total weight of the surfactant whose molecular weight is about 1500.

Surfactant B is a polyoxyethylene polyoxypropylene copolymer of the formula:

$$HO(C_2H_4O)_b(C_3H_6O)_a(C_2H_4O)_bH$$

wherein a is an integer such that the hydrophobe base represented by $(C_3H_6O)$ has an average molecular weight of at least 3200 and b is an integer such that the hydrophile represented by $(C_2H_4O)$ constitutes from about 70 to 95 weight percent of the copolymer.

The addition of certain inorganic salts to formulations of this invention may be made with no adverse effect on the gel formation. Only a slight decrease in gel temperature was obtained when 0.25 weight percent sodium metasilicate, 0.5 weight percent sodium tripolyphosphate, 0.5 weight percent trisodium phosphate or 0.5 weight percent sodium borate were added. Increased amounts of these salts, however, caused a marked decrease in gel temperature. Salts such as sodium chloride or ammonium hydroxide at a concentration of 0.5 weight percent completely eliminated the gel formation.

The use of the two types of surfactants disclosed appears to be unique in their ability to form a gel in a mixture of water, alkali metal hydroxide and surfactant. It has been discovered that the addition of about 0.1 or more weight percent of anionic or cationic surfactants completely inhibits the gel formation.

EXAMPLES 2–89

The criteria established in determining whether a gel was satisfactory involved the determination of the flowability of the gel from a heated metal strip held in a vertical position. The various solutions set forth in Examples 2 thru 89 in Tables I and II were tested by heating in a test tube and determining the temperature at which the solution formed a gel. The consistency of the gel was then determined by dipping a metal strip, that had been heated above the gel temperature, into the particular solution, which was at room temperature, or by spraying the solutions onto stainless steel strips suspended vertically in an oven at a temperature higher than the gel temperature for that particular solution. Only those gels which did not flow from the vertical strips were considered satisfactory. These are set forth in Examples 2 thru 89.

TABLE I

| Example | Surfactant | % Surfactant | Alkali | % Alkali |
|---|---|---|---|---|
| 2 | A | 20 | NaOH | 3 |
| 3 | A | 30 | NaOH | 3 |
| 4 | A | 10 | NaOH | 4 |
| 5 | A | 20 | NaOH | 4 |
| 6 | A | 10 | NaOH | 5 |
| 7 | A | 15 | NaOH | 5 |
| 8 | A | 25 | KOH | 3 |
| 9 | A | 30 | KOH | 3 |
| 10 | A | 16 | KOH | 4 |
| 11 | A | 30 | KOH | 4 |
| 12 | A | 12 | KOH | 5 |
| 13 | A | 30 | KOH | 5 |
| 14 | A | 9 | KOH | 7 |
| 15 | A | 15 | KOH | 7 |
| 16 | B | 10 | NaOH | 1 |
| 17 | B | 20 | NaOH | 1 |
| 18 | B | 10 | NaOH | 2 |
| 19 | B | 20 | NaOH | 2 |
| 20 | B | 5 | NaOH | 3 |
| 21 | B | 15 | NaOH | 3 |
| 22 | B | 5 | NaOH | 4 |
| 23 | B | 15 | NaOH | 4 |
| 24 | B | 15 | KOH | 1 |
| 25 | B | 20 | KOH | 1 |
| 26 | B | 10 | KOH | 2 |
| 27 | B | 20 | KOH | 2 |
| 28 | B | 10 | KOH | 3 |
| 29 | B | 20 | KOH | 3 |
| 30 | B | 6 | KOH | 4 |
| 31 | B | 21 | KOH | 4 |
| 32 | B | 6 | KOH | 5 |
| 33 | B | 20 | KOH | 5 |
| 34 | B | 4 | KOH | 6 |
| 35 | B | 8 | KOH | 6 |

TABLE II

| Example | Surfactant | % Surfactant | Alkali NaOH/KOH Ratio | % Alkali |
|---|---|---|---|---|
| 36 | A | 30 | 1/1 | 2 |
| 37 | A | 30 | 1/2 | 3 |
| 38 | A | 25 | 1/2 | 3 |
| 39 | A | 30 | 1/3 | 4 |
| 40 | A | 12 | 1/3 | 4 |
| 41 | A | 25 | 1/4 | 5 |
| 42 | A | 10 | 1/4 | 5 |
| 43 | A | 20 | 1/5 | 6 |
| 44 | A | 7 | 1/5 | 6 |
| 45 | A | 20 | 2/1 | 3 |
| 46 | A | 13 | 2/1 | 3 |
| 47 | A | 25 | 2/2 | 4 |
| 48 | A | 15 | 2/2 | 4 |
| 49 | A | 20 | 2/3 | 5 |
| 50 | A | 8 | 2/3 | 5 |
| 51 | A | 15 | 2/4 | 6 |
| 52 | A | 7 | 2/4 | 6 |
| 53 | A | 10 | 2/5 | 7 |
| 54 | A | 8 | 2/5 | 7 |
| 55 | A | 25 | 3/1 | 4 |
| 56 | A | 10 | 3/1 | 4 |
| 57 | A | 20 | 3/2 | 5 |
| 58 | A | 8 | 3/2 | 5 |
| 59 | A | 12 | 3/3 | 6 |
| 60 | A | 8 | 3/3 | 6 |
| 61 | A | 15 | 4/1 | 5 |
| 62 | A | 8 | 4/1 | 5 |
| 63 | A | 10 | 4/2 | 6 |
| 64 | A | 8 | 4/2 | 6 |
| 65 | A | 10 | 5/1 | 6 |
| 66 | A | 7 | 5/1 | 6 |
| 67 | B | 15 | 1/1 | 2 |
| 68 | B | 10 | 1/1 | 2 |
| 69 | B | 21 | 1/2 | 3 |
| 70 | B | 6 | 1/2 | 3 |
| 71 | B | 18 | 1/3 | 4 |
| 72 | B | 5 | 1/3 | 4 |

TABLE II-continued

| Example | Surfactant | % Surfactant | Alkali NaOH/KOH Ratio | % Alkali |
|---|---|---|---|---|
| 73 | B | 15 | 1/4 | 5 |
| 74 | B | 5 | 1/4 | 5 |
| 75 | B | 22 | 2/1 | 3 |
| 76 | B | 5 | 2/1 | 3 |
| 77 | B | 15 | 3/1 | 4 |
| 78 | B | 5 | 3/1 | 4 |
| 79 | B | 6 | 4/1 | 5 |
| 80 | B | 4 | 4/1 | 5 |
| 81 | B | 15 | 2/2 | 4 |
| 82 | B | 5 | 2/2 | 4 |
| 83 | B | 10 | 3/2 | 5 |
| 84 | B | 5 | 3/2 | 5 |
| 85 | B | 12 | 2/3 | 5 |
| 86 | B | 7 | 2/3 | 5 |
| 87 | B | 6 | 2/4 | 6 |
| 88 | B | 5 | 3/3 | 6 |

EXAMPLE 89

| Component | Weight Percent |
|---|---|
| Water | 82.6 |
| Potassium Hydroxide | 3.0 |
| Sodium Hydroxide | 2.0 |
| Surfactant B | 12.0 |
| Sodium Metasilicate | 0.2 |
| Phosphoric acid | 0.2 |
| | 100.0 |

EXAMPLE 90

The surfactants listed below were tested at a 15 weight percent concentration of surfactant in water with an alkali concentration of 5 weight percent in the ratio of 2:3 NaOH:KOH. Under these conditions the surfactants were either insoluble or the solutions did not form a gel at temperatures as high as 212° F.

Surfactant C—a polyoxyethylene polyoxypropylene copolymer wherein the oxypropylene portion has a molecular weight of about 2750 and the oxyethylene portion constitutes about 80 weight percent of the copolymer.

Surfactant D—a polyoxyethylene polyoxypropylene copolymer wherein the oxypropylene portion has a molecular weight of 1700 and the oxyethylene portion constitutes about 80 weight percent of the copolymer.

Surfactant E—a polyoxyethylene polyoxypropylene copolymer wherein the oxypropylene portion has a molecular weight of 3000 and the oxyethylene portion constitutes about 80 weight percent of the copolymer.

Surfactant F—a polyoxyethylene polyoxypropylene adduct of ethylene diamine wherein the oxypropylene portion has a molecular weight of 3700 and the oxyethylene portion constitutes about 85 weight percent of the adduct.

Surfactant G—an ethoxylated alcohol wherein the straight chain alkyl group has an average of about 15 carbon atoms, the oxyethylene constitutes about 80 weight percent of the surfactant and the molecular weight of the product is about 1000.

Surfactant H—an ethoxylated nonylphenol wherein the oxyethylene constitutes about 90 weight percent of the surfactant.

EXAMPLES 91–108

As previously mentioned it is possible to vary the gel temperature by varying both the concentration of the alkali metal hydroxide or the type or concentration of the surfactant. The following examples exemplify the variations in gel temperature which are possible.

| Example | Surfactant | % Surfactant | Alkali | % Alkali | Gel Temperature °F. |
|---|---|---|---|---|---|
| 91 | B | 15 | NaOH | 1 | 182 |
| 92 | B | 20 | NaOH | 2 | 144 |
| 93 | B | 13 | NaOH | 3 | 122 |
| 94 | B | 9 | NaOH | 4 | 121 |
| 95 | A | 30 | KOH | 2 | 178 |
| 96 | A | 20 | KOH | 4 | 158 |
| 97 | A | 10 | KOH | 7 | 119 |
| 98 | B | 18 | Mixed | 2 | 158 |
| 99 | B | 10 | Mixed | 4 | 130 |
| 100 | B | 4 | Mixed | 5 | 109 |
| 101 | A | 25 | NaOH | 3 | 135 |
| 102 | A | 18 | NaOH | 4 | 118 |
| 103 | A | 10 | NaOH | 5 | 116 |
| 104 | A | 8 | Mixed | 6 | 129 |
| 105 | A | 6 | Mixed | 6 | 116 |
| 106 | B | 20 | KOH | 4 | 108 |
| 107 | B | 10 | KOH | 5 | 132 |
| 108 | B | 4 | KOH | 6 | 134 |

The embodiments of the invention in which an exclusive property or privilege is claimed are defined as follows:

1. An aqueous composition, which gels at temperatures greater than 100° F., suitable for the removal of greasy soil from surfaces consisting essentially of water, an alkali metal hydroxide and a surfactant selected from the group consisting of (a) an ethoxylated alcohol of the formula:

$$Y—O(C_2H_4O)_nH$$

wherein Y is a straight chain alkyl group having an average of 19 carbon atoms, n is an integer such that the hydrophile represented by $(C_2H_4O)$ constitutes from about 75 to 95 weight percent of the total weight of the surfactant and the molecular weight is about 1500 and (b) a polyoxyethylene-polyoxypropylene copolymer of the formula:

$$HO(C_2H_4O)_b(C_3H_6O)_a(C_2H_4O)_bH$$

wherein a is an integer such that the hydrophobe base represented by $(C_3H_6O)$ has an average molecular weight of at least 3200 and b is an integer such that the hydrophile represented by $(C_2H_4O)$ constitutes from about 70 to 95 weight percent of the copolymer, wherein the concentration of alkali metal hydroxide is from about 1 weight percent to about 7 weight percent, the concentration of surfactant is from 4 weight percent to about 30 weight percent and the balance is water.

2. The composition of claim 1 wherein the surfactant concentration is from about 10 percent to about 20 percent of the total mixture.

3. The composition of claim 1 wherein the alkali metal hydroxide concentration is from about 2 percent to about 7 percent of the total mixture.

4. The composition of claim 3 wherein the alkali metal hydroxide is selected from the group consisting of sodium hydroxide and potassium hydroxide and mixtures thereof.

* * * * *